US007921937B2

(12) United States Patent
Brackin et al.

(10) Patent No.: US 7,921,937 B2
(45) Date of Patent: Apr. 12, 2011

(54) DRILLING COMPONENTS AND SYSTEMS TO DYNAMICALLY CONTROL DRILLING DYSFUNCTIONS AND METHODS OF DRILLING A WELL WITH SAME

(75) Inventors: Van J. Brackin, Spring, TX (US); Paul E. Pastusek, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 26 days.

(21) Appl. No.: 11/970,103

(22) Filed: Jan. 7, 2008

(65) Prior Publication Data

US 2008/0164062 A1 Jul. 10, 2008

Related U.S. Application Data

(60) Provisional application No. 60/879,419, filed on Jan. 8, 2007.

(51) Int. Cl.
*E21B 44/04* (2006.01)

(52) U.S. Cl. ..... 175/24; 175/107

(58) Field of Classification Search ..... 175/38, 175/26, 107, 92

See application file for complete search history.

(56) References Cited

U.S. PATENT DOCUMENTS

| | | | | |
|---|---|---|---|---|
| 4,396,071 | A * | 8/1983 | Stephens | 175/50 |
| 4,615,401 | A | 10/1986 | Garrett | |
| 4,660,656 | A | 4/1987 | Warren et al. | |
| 4,854,397 | A | 8/1989 | Warren et al. | |
| 5,421,420 | A | 6/1995 | Malone et al. | |
| 5,813,480 | A | 9/1998 | Zaleski, Jr. et al. | |
| 5,842,149 | A | 11/1998 | Harrell et al. | |
| 5,884,716 | A | 3/1999 | Beasley | |
| 6,021,377 | A * | 2/2000 | Dubinsky et al. | 702/9 |
| 6,102,138 | A | 8/2000 | Fincher | |
| 6,206,108 | B1 | 3/2001 | MacDonald et al. | |
| 6,233,524 | B1 | 5/2001 | Harrell et al. | |

(Continued)

FOREIGN PATENT DOCUMENTS

| | | | |
|---|---|---|---|
| GB | 2044826 | A | 10/1980 |
| GB | 2330848 | A | 5/1999 |

OTHER PUBLICATIONS

Dashevskiy, D., et al., Application of Neural Networks for Predictive Control in Drilling Dynamics, 1999 SPE Annual Technical Conference and Exhibition, Oct. 3-6, 1999, pp. 1-8, SPE 56442.

(Continued)

*Primary Examiner* — Kenneth Thompson
*Assistant Examiner* — James G. Sayre
(74) *Attorney, Agent, or Firm* — TraskBritt

(57) ABSTRACT

Drilling tools that may detect and dynamically adjust drilling parameters to enhance the drilling performance of a drilling system used to drill a well. The tools may include sensors, such as RPM, axial force for measuring the weight on a drill bit, torque, vibration, and other sensors known in the art. A processor may compare the data measured by the sensors against various drilling models to determine whether a drilling dysfunction is occurring and what remedial actions, if any, ought to be taken. The processor may command various tools within the bottom hole assembly (BHA), including a bypass valve assembly and/or a hydraulic thruster to take actions that may eliminate drilling dysfunctions or improve overall drilling performance. The processor may communicate with a measurement while drilling (MWD) assembly, which may transmit the data measured by the sensors, the present status of the tools, and any remedial actions taken to the surface.

22 Claims, 9 Drawing Sheets

U.S. PATENT DOCUMENTS

| | | | | |
|---|---|---|---|---|
| 6,378,627 | B1 | 4/2002 | Tubel et al. | |
| 6,568,485 | B2 * | 5/2003 | Falgout, Sr. | 175/26 |
| 6,662,110 | B1 | 12/2003 | Bargach et al. | |
| 6,732,052 | B2 | 5/2004 | Macdonald et al. | |
| 6,944,547 | B2 | 9/2005 | Womer et al. | |
| 6,968,909 | B2 | 11/2005 | Aldred et al. | |
| 7,054,750 | B2 | 5/2006 | Rodney et al. | |
| 7,523,792 | B2 * | 4/2009 | El-Rayes et al. | 175/92 |
| 2001/0045300 | A1 | 11/2001 | Fincher et al. | |
| 2006/0272859 | A1 | 12/2006 | Pastusek | |
| 2007/0272442 | A1 | 11/2007 | Pastusek | |

OTHER PUBLICATIONS

Dupriest, Fred E., et al., Maximizing Drill Rates with Real-Time Surveillance of Mechanical Specific Energy, SPE/IADC Drilling Conference, Feb. 23-25, 2005, pp. 1-10, SPC/IADC 92194.

Finger, J.T., et al., Development of a System for Diagnostic-While Drilling (DWD), SPE/IADC Drilling Conference, Feb. 19-21, 2003, pp. 1-9, SPE/IADC 79884.

Baker Hughes Inteq, 6-3/4" Ultra Series Motor Spare Part List, print date Apr. 12, 2006, pp. 1-6.

Baker Hughes Inteq, Navi-Drill Ultra Series, High Performance, Extended Length Motors, brochure dated 1999, 9 pages.

Baker Hughes Inteq, The AutoTrak System, Rotary Closed-Loop Drilling System, brochure dated 2001, 16 pages.

Schlumberger, PowerPak, Steerable Motor Handbook, 2004, pp. 1-203.

PCT International Search Report for PCT International Application No. PCT/US2008/000203, mailed Jul. 31, 2008.

* cited by examiner

DRILLING COMPONENTS AND SYSTEMS TO DYNAMICALLY CONTROL DRILLING DYSFUNCTIONS AND METHODS OF DRILLING A WELL WITH SAME

CROSS-REFERENCE TO RELATED APPLICATIONS

This application claims the benefit of U.S. Provisional Patent Application Ser. No. 60/879,419, filed Jan. 8, 2007, the disclosure of which is hereby incorporated herein in its entirety by this reference.

FIELD OF THE INVENTION

Embodiments of the invention relate to bottom hole assemblies and components thereof that may detect drilling parameters and dynamically adjust operational aspects of the bottom hole assembly to enhance performance of a drill bit and other components of the bottom hole assembly, and to methods of drilling.

BACKGROUND

Hydrocarbons are obtained by drilling wells with a drill bit attached to a drill string that is rotated from the surface and, in some instances, by a downhole motor in addition to or in lieu of surface rotation. A drill bit that is used to drill through the earth is connected to what is termed a bottom hole assembly (BHA) that may include components such as, for example, one or more drill collars, stabilizers, and, more recently, drilling motors and logging tools that measure various drilling and geological parameters. The BHA is connected to a long series of drill pipe sections threaded and extending to the bit at the bottom of the well, with subsequent sections of drill pipe added as needed as the well is drilled deeper. Collectively, the drill bit, BHA, and lengths of drill pipe comprise what is referred to as the drill string.

The drilling process causes significant wear on the each of the components of the drill string, in particular the drill bit and the BHA. Managing the wear and conditions that lead to premature failure of downhole components is a significant aspect in minimizing the time and cost of drilling a well. Some of the conditions, often collectively referred to as drilling dysfunctions, that may lead to premature wear and failure of the drill bit and the BHA include excessive torque, shocks, bit bounce, bit whirl, stick-slip, and others known in the art.

Bit whirl, for example, is characterized by a chaotic lateral translation of the bit and the BHA, frequently in a direction opposite to the direction of rotation. Whirl may cause high shocks to the bit and the downhole tools, leading to premature failure of the cutting structure of the bit, as well as the electrical and mechanical components of the downhole tools and collars. Whirl may be a result of several factors, including a poorly balanced drill bit, i.e., one that has an unintended imbalance in the lateral forces imposed on the bit during the drilling process, the cutting elements on the drill bit engaging the undrilled formation at a depth of cut too shallow to adequately provide enough force to stabilize the bit, and other factors known to those having ordinary skill in the art. Additionally, bit whirl may be caused in part by the cutting elements on the drill bit cutting too deeply into a formation, leading the bit to momentarily stop rotating, or stall. During this time, the drill pipe continues rotating, storing the torque within the drill string until the torque applied to the bit increases to the point at which the cutting elements break free in a violent fashion.

Other drilling dysfunctions may result from a cutting element on the drill bit cutting too deeply into a formation. For example, a drill bit may cut more formation material than can adequately be removed hydraulically from the face and the junk slots of the drill bit, possibly leading to a condition known as bit "balling" where the formation cuttings clog the waterways and junk slots of the bit, or the area around the BHA and the drill pipe may become filled with formation debris, possibly leading to a packed hole, stuck pipe, or other significant problems.

Another, separate problem involves drilling from a zone or stratum of higher formation compressive strength to a "softer" zone of lower strength. As the bit drills into the softer formation without changing the applied weight on bit, or WOB, or before the WOB can be changed by the driller, the depth to which the cutting elements of the bit engage the formation and, thus, the resulting torque on the bit, increase almost instantaneously and by a substantial magnitude. The abruptly higher torque, in turn, may cause damage to the cutting elements and/or to the drill bit body itself. In directional drilling, such a change may cause the tool face orientation of the directional (measuring-while-drilling, or MWD, or a steering tool) assembly to fluctuate, making it more difficult for the directional driller to follow the planned directional path for the drill bit. Thus, it may be necessary for the directional driller to raise the drill bit from the bottom of borehole to re-set, or re-orient the tool face. In addition, a downhole motor, if used, may completely stall under a sudden torque increase. That is, the drill bit may stop rotating, thereby stopping the drilling operation and, again, necessitating raising the drill bit from the bottom of the borehole to re-establish drilling fluid flow and motor output. Such interruptions in the drilling of a well can be time consuming and quite costly.

Similarly, drilling from a zone or stratum of lower formation compressive strength to a "harder" zone of higher compressive strength poses certain problems. As the bit drills into the harder formation without changing the applied WOB, or before the WOB can be changed by the driller, the depth to which the cutting elements of the bit engage the formation decreases almost instantaneously and by a substantial magnitude. If the cutting elements do not engage the formation to a sufficient depth at a low WOB, the drill bit and the BHA may begin to whirl, possibly damaging the drill bit, sensors, and other BHA components. Once whirl begins, often the only recourse is to raise the drill bit off the bottom of the hole, stop rotating the drill bit and the drill string until all rotation ceases. Once the rotation has ceased, the driller may attempt to begin drilling again by slowly increasing the rate at which the drill bit and the drill string rotates and, subsequently, returning the drill bit to the bottom of the borehole, frequently using different drilling parameters, e.g. higher WOB. The drilling parameters again should be carefully monitored to discern whether the new drilling parameters have mitigated or minimized the whirl or whether the drill bit has begun whirling again. As mentioned, such interruptions in the drilling of a well can be time consuming and quite costly, especially if the drill bit or the components of the drill string are damaged by the shocks induced by the whirl and have to be replaced.

Significant efforts have been made to design drill bits and tools that mitigate or, preferably, eliminate drilling dysfunctions such as are discussed above. These efforts, achieving varying degrees of success, are undoubtedly helpful, yet may be inadequate because the downhole environment encountered by the BHA may differ, sometimes significantly, from that anticipated during the drill bit and drill string component design and selection process. For example, a bit may be designed or selected in part based on the formations encountered in nearby wells or from seismic data. However, the geology actually encountered in the well during the drilling process may have different characteristics or may be encountered at an unexpected depth from that initially predicted. Thus, a drill bit or downhole tool that seemed particularly suited for an application initially may be, in reality, less than ideal or even fairly unsuitable for the actual application. Thus, the effort to minimize drilling dysfunctions may rely on a reactive process to the circumstances observed during drilling, as described below. Further, even if the ideal bit or tool is selected, the optimum drilling parameters must be found to minimize the time and cost to drill a well.

During drilling, various parameters measured at the surface and downhole are observed and the occurrence of a certain drilling dysfunction downhole may be inferred from the measurements. Once a drilling dysfunction has been inferred, corrective measures, such as modifying surface parameters (inputs), may be taken that should, in theory, at least mitigate, if not eliminate, the drilling dysfunction. The various parameters observed earlier are monitored after the corrective measures have been taken in an effort to determine whether the corrective measures were effective.

Software programs may identify drilling dysfunctions from measured data and recommend corrective actions. One example of such a software program, as described in U.S. Pat. No. 6,732,052, to MacDonald, et al., assigned to the assignee of the present invention and the disclosure of which is hereby incorporated herein by reference, comprises a neural network that may be trained to identify drilling dysfunctions and recommend certain actions be taken to remedy the drilling dysfunctions.

Another example of efforts to identify and counteract or control drilling dysfunctions is the use of closed loop drilling systems that harness advances in downhole computing power and sensor technology to drill wells more quickly and with fewer risks than earlier directional drilling methods. Closed loop drilling systems, such as that described in U.S. Pat. No. 5,842,149 to Harrell, et at., assigned to the assignee of the present invention and the disclosure of which is hereby incorporated herein by reference, employ a downhole motor that includes integral sensors and an MWD system. The sensors may measure the tri-axial forces on the BHA, the downhole torque, the downhole WOB (the force applied to the bit along the axial direction), the shocks that the drilling system undergoes during the drilling process, and other relevant parameters as known in the art. Computer processors within the drilling system process the raw data from the sensors and analyze the results, comparing the processed data against models of various drilling dysfunctions in an effort to determine whether any of the modeled drilling dysfunctions are presently occurring. The MWD system may communicate the processed data and the analysis of whether a drilling dysfunction is occurring to the surface along with any recommended corrective actions to be undertaken.

Such software programs and closed loop drilling systems may permit a faster recognition of drilling dysfunctions and, in theory, a commensurately faster response to mitigate the drilling dysfunctions. However, systems that identify drilling dysfunctions and recommend corrective actions may he inadequate in certain situations, as described herein.

First, the software programs and the closed loop drilling systems may require the active intervention of an operator at the surface to take corrective action to remedy certain drilling dysfunctions, which may pose several concerns. As an initial constraint, changes made to the surface input parameters rarely are transmitted with complete efficiency to the drill bit. For example, changing the weight applied to the bit from the surface (surface WOB) by a given amount rarely equates to an equivalent change in the WOB applied downhole (downhole WOB). This may occur because a portion of the surface WOB is lost via friction between the drill pipe and the wellbore, particularly in deviated wells. Similar drill pipe/wellbore interactions may cause the torque applied at the bit (downhole torque) to be measurably less than the torque as measured at the surface. Thus, the process of mitigating a drilling dysfunction is an iterative one in that the operator must wait to see what, if any, effect a change in an input parameter will have on the desired output.

Unfortunately, such an iterative process of making changes to the surface parameters and evaluating the resulting change on the drill bit and the drill string may take considerable time, during which the drilling dysfunction may be continuing. For example, in cases of extremely high shocks (on the order of 100 times the force of gravity), which may be indicative of bit whirl, failure of the electronic components of the downhole tools (for example, of an MWD tool or of a logging while drilling (LWD) tool) or failure of the drill bit (e.g., damage to the cutting elements), or worse, may occur in minutes. Should a downhole component fail prematurely, an unplanned trip to pull the tools out of the hole and replace the component may have to be made, significantly increasing the time and the cost of drilling a well.

Further compounding the time to remedy drilling dysfunctions because of the inherent inefficiencies in the transfer of inputs at the surface to the drill bit and the resulting time to iteratively reach an improved result, an inherent delay exists in transferring data gathered by the sensors on the tools in the wellbore to the surface. In the case of a closed loop drilling system and most MWD and LWD tools, the downhole information is conventionally transmitted to the surface by encoding the data in a series of pressure changes applied to the drilling fluid in the drill string, commonly termed "mud pulse telemetry," as known in the art. Special pressure transducers on the drilling standpipe at the surface measure the pressure changes in the drilling fluid in the drill string and transmit the data to a computer to be decoded. In many situations, such a system works effectively, if somewhat slowly, as data transmission rates often range between 1.5 to 12 bits per second. The slow data transmission rate is one of the primary reasons that much of the data measured downhole is processed downhole before being transmitted to the surface. However, the delay may have significant consequences in those instances in which a drilling dysfunction needs to be rectified extremely quickly before a catastrophic failure occurs, as discussed above.

Further, "noise" in the pressure signal may cause difficulty for the computer system attempting to decode the data encoded in the drilling pulses. For example, the natural harmonic frequency of the drilling pumps that circulates the drilling fluid may mask the encoded pressure pulses from the MWD tool. Worse, many drilling dysfunctions, in particular bit whirl and shocks to the drilling tools, may cause their own pressure fluctuations in the drilling fluid, further masking the encoded signal. As a result, the computer system may incorrectly decode the pressure pulses or fail to decode the pulses at all while a drilling dysfunction occurs, resulting in either incorrect or no data from downhole being decoded. Thus, just at the moment when a drilling dysfunction may be at its worst, the operator may be without any, or any accurate, information as to the drilling environment at the bottom of the hole, leaving the operator to make educated guesses as to the possible causes of the drilling dysfunction and the appropriate remedial action.

Thus, drilling dysfunctions may pose serious difficulties during the drilling process and may be difficult to predict beforehand. Further, drilling dysfunctions may often be hard to identify and remedy at the well site given the sometimes limited precision of the tools with which an operator has to work with at the surface. Thus, a need exists for tools and methods that may quickly identify and mitigate drilling problems as they occur during the drilling process with minimal intervention.

BRIEF SUMMARY OF THE INVENTION

Embodiments of the present invention relate to drilling components and systems configured for dynamic adjustment of operational aspects of a drilling system in response to data relating to drilling performance parameters measured downhole.

An embodiment of the invention includes one or more sensors for measuring various downhole parameters, a processor, and a software package to analyze the data measured by the sensors. The processor and software package may be connected to downhole components that may be used to adjust various inputs to other components associated with the drilling process in response to commands from the processor and the software package. The downhole components may include a valve, and a downhole motor. The valve may open and close under the direction of the processor to divert a portion of the drilling fluid in the drill string away from a power section of the downhole motor. The diverted drilling fluid may be at least partially diverted to the well bore or it may be at least partially diverted through a hollow rotor within the downhole motor, bypassing the power section of the motor. As a result of diverting at least a portion of the drilling fluid, the rate at which the downhole motor rotates the drill bit may be controlled.

Another embodiment of the invention may include a hydraulic thruster, configured and located to provide a force along the axial direction of the drill string. A valve in the thruster may be connected to the sensors and under the control of the processor and the software program. The valve may be dynamically adjusted to control the response of the thruster and, therefore, dynamically adjust the force that the thruster applies along the axial direction to the drill bit. The thruster may optionally be employed with a downhole motor, or the hydraulic thruster may be employed in a conventional BHA assembly without a motor.

Other embodiments of the invention may include a drilling collar, or sub, that combines the electronic components, the software package, and the processor of the invention with a bypass valve assembly to divert the drilling fluid away from the power section of a downhole motor, a thruster, or both, in a single sub.

Further embodiments of the invention include methods of drilling comprising selectively controlling drilling fluid flow through a bottom hole assembly to adjust, for example bit rotational speed, axial force applied to a bit, or both. Other operational aspects of the bottom hole assembly may be adjusted, and any such adjustments may be effected responsive to measured values of downhole performance parameters during drilling.

Other features and advantages of the present invention will become apparent to those of ordinary skill in the art through consideration of the ensuing description, the accompanying drawings, and the appended claims.

DETAILED DESCRIPTION

In the appended drawing figures, like components and features among the various embodiments have been identified by like reference numbers, for convenience and clarity.

Figure 1:
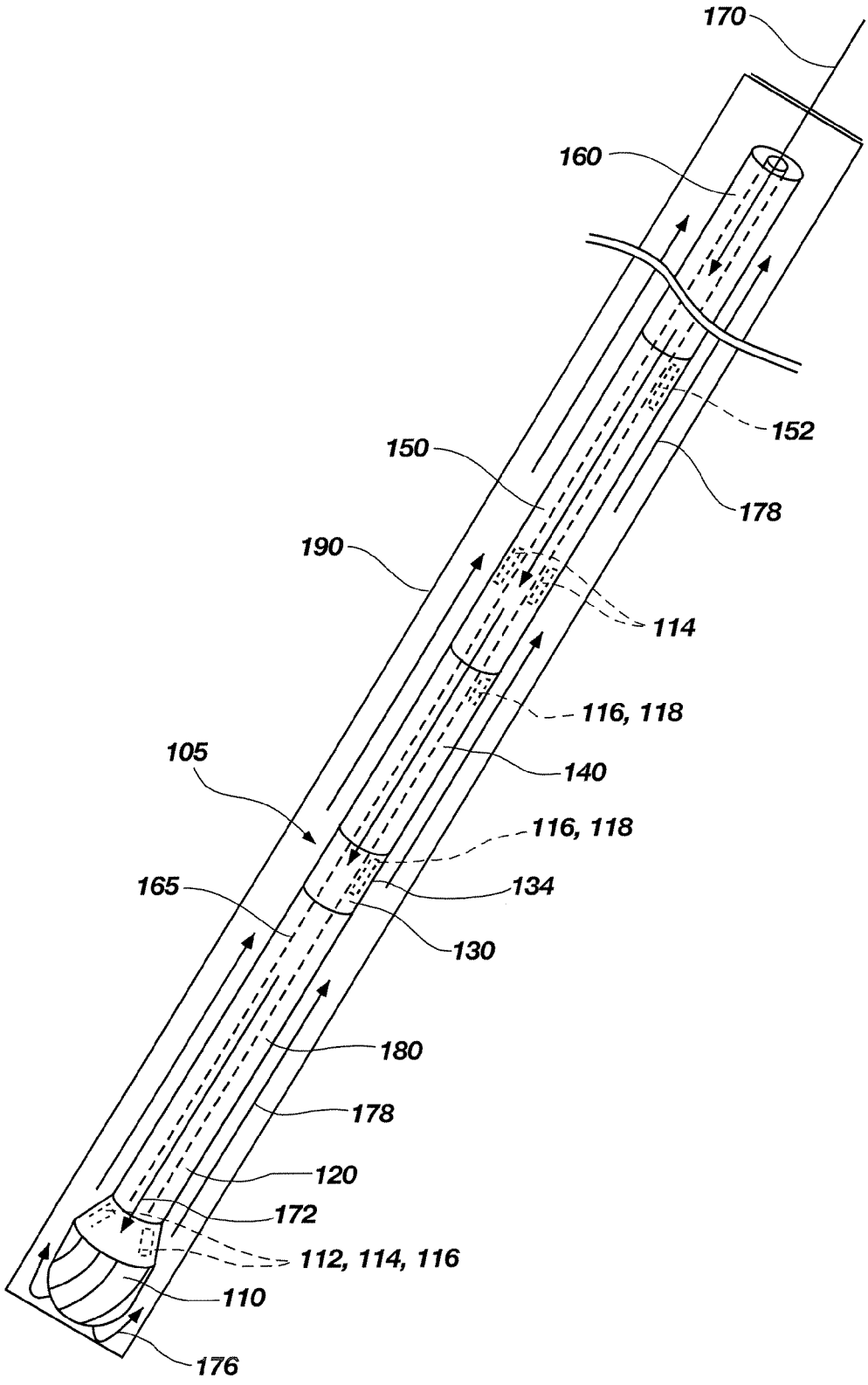
FIG. 1 schematically depicts an embodiment of a drilling system that includes a drill bit, downhole motor, bypass valve assembly, hydraulic thruster, and a MWD system.

An embodiment of the present invention is illustrated in FIG. 1. The bottom hole assembly (BHA) 105 may include a drill bit 110 that may be connected to a downhole motor 120. Optionally, the BHA 105 may include additional components, such as a bypass valve assembly 130, a thruster 140, and an MWD system 150. Other, conventional, components of the BHA 105 that may be included, but are not shown, are logging while drilling (LWD) tools, drill collars, drilling jars, stabilizers, reamers, sensor packages that measure various parameters, including shocks, vibration, and pressure, and the like. While the bypass valve assembly 130, the thruster 140, and the MWD system 150 are shown in a particular order within the BHA 105 in FIG. 1, it will be appreciated that these components may be reordered as best suited for a particular application. The drill string 160 may include additional dill collars and drill pipes of various sizes, and connects the BHA 105 to the surface. Drilling fluid 170 flows through the drill string 160 and BHA 105 to drive downhole motor 120 through fluid passage 165 before exiting bit 110 at 176 through nozzles (not shown) on the bit face and passing upwardly as shown at 178 to the surface in the annulus between the drill string 160 and the wellbore wall 190.

The drill bit 110 may be any drill bit known in the art. For example, the drill bit 110 may be a roller cone type drill bit or a fixed cutter, or "drag" type drill bit employing superabrasive cutting elements such as polycrystalline diamond compacts, or "PDCs." Other drill bits that may be used in embodiments of the invention include impregnated bits, natural diamond bits, bicenter bits, eccentric bits, reamers, core bits, mills, and the like.

Optionally, the drill bit 110 may include sensors for measuring values of performance parameters including, by way of non-limiting example, the rotational speed of the bit, the component forces acting on the bit (e.g., axial and lateral forces), the torque acting on the bit, and others sensors known in the art. For example, an embodiment of the invention may employ a drill bit 110 that includes a sensor package 112 comprising sensors 114 similar to the one described in U.S. Pat. No. 5,813,480 to Zaleski and Schmidt, assigned to the assignee of the present invention and the disclosure of which is hereby incorporated herein by reference. Other embodiments of the invention may include sensors 114 and associated electronics configured and arranged in a drill bit 110 as disclosed in U.S. patent applications Ser. No. 11/146,934 filed Jun. 7, 2005, now U.S. Pat. No. 7,604,072, issued Oct. 20, 2009, and Ser. No. 11/708,147 filed Feb. 16. 2007, now U.S. Pat. No. 7,849,934, issued Dec. 14, 2010, each of which application is assigned to the assignee of the present invention and the disclosure of each of which is hereby incorporated herein by reference. Using an instrumented drill bit, while not necessary in the embodiments of the invention, may be preferential because the sensors in such a drill bit are closer to the formation and the drilling environment most significantly affecting the drilling process than sensors elsewhere in the BHA and, therefore, may provide a more useful measurement than sensors further from the drill bit, such as those located in the MWD system 150 or in LWD tools, as will be described below.

A drill bit 110 having such sensors 114 may process the data using a semiconductor-based processor 116 and other associated electronics. The processed data, such as the force, torque, and the like, may be the calibrated values of the raw measurement. Additionally, the processor 116 may be used to compare the measured data against models of various drilling dysfunctions. For example, an axial force sensor in the bit may measure a sudden increase in the WOB applied to the bit 110 while at the same time noting a large increase in the torque applied to the bit. The processor may be programmed to recognize that a sudden increase in the WOB may be caused by the cutting elements of the drill bit 110 cutting too deeply into the formation, resulting in the sudden increase in torque. This information may be communicated to other tools in the drill string, including the bypass valve assembly 130, the thruster 140, and/or to the surface through telemetry equipment 152 associated with the MWD system 150 and used to mitigate the causative factors, as will be described in detail below. In addition, the processor 116 may be used to compare the measured data against drilling performance models for different formation types (e.g., soft, hard, abrasive, non-abrasive) to determine a type of subterranean formation being drilled and any transition from one formation type to another.

Figure 2:
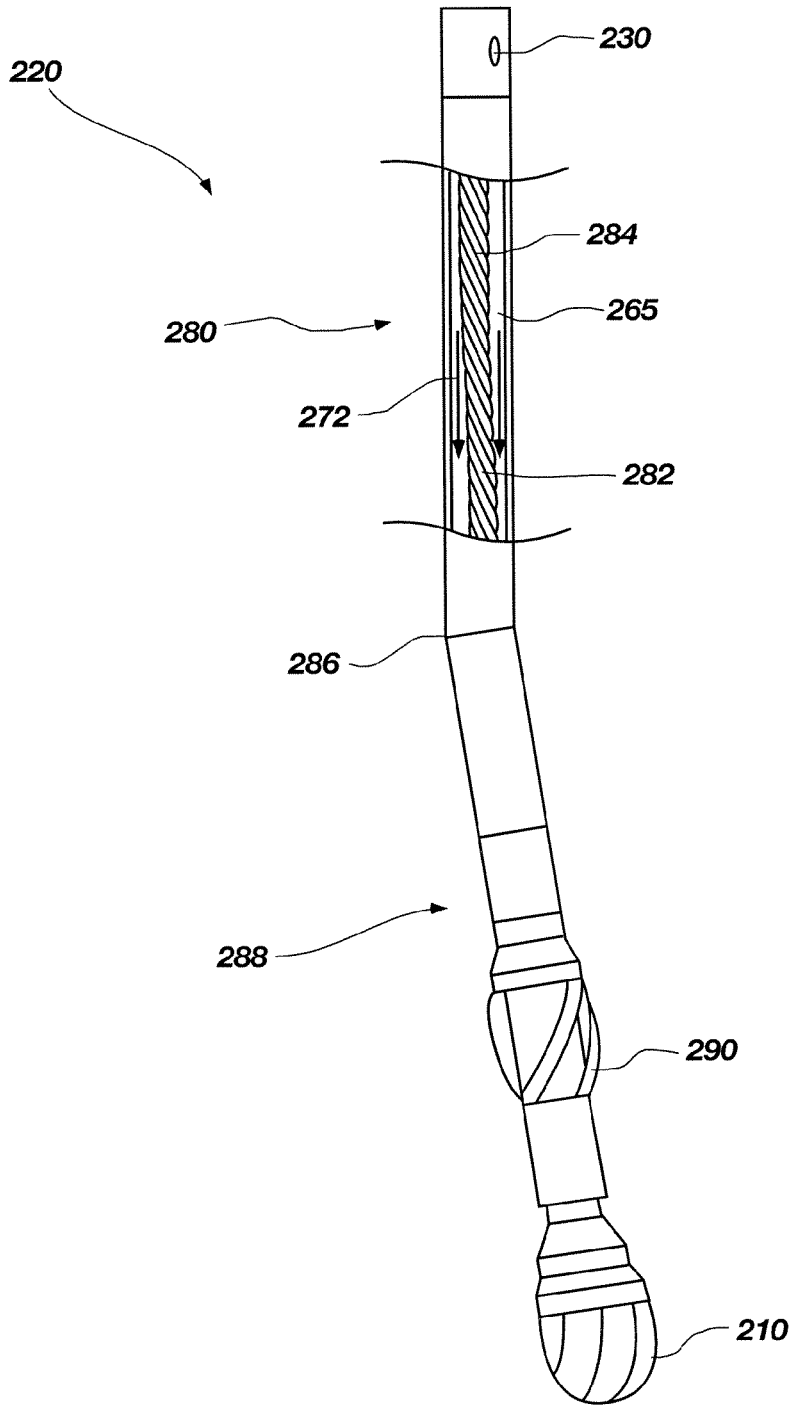
FIG. 2 depicts a schematic partial cross-sectional view of a downhole motor that may employed in implementations of embodiments of the present invention.

A downhole motor 220 may be used in an embodiment of the invention, a more detailed depiction of which may be seen in FIG. 2. The downhole motor 220 may be a positive displacement motor (PDM) that uses the Moineau principle to drive a rotor to rotate a drill bit 210 as drilling fluid passes through the motor. Optionally, the downhole motor 220 may include a bent sub or housing 286 that may be used during directional drilling to selectively drill the well in a desired direction, stabilizer 290 being disposed below bent housing 286 and above drill bit 210. Instead of including the bent sub 286, the motor 220 may be part of a rotary steerable system (RSS) that may be used for directional drilling, such as the closed loop drilling system described in U.S. Pat. No. 5,842,149 to Harrell, et al., referenced above. The downhole motor 220 may also comprise a turbine motor or turbodrill, as known in the art.

Regardless of the type of downhole motor 220, the principal of operation is the same for each. The power section 280 of the downhole motor 220 converts a portion of the hydraulic horsepower present in the drilling fluid 272, which flows between a rotor 282 and a stator 284 of the power section 280 and exits the drill bit 210 through nozzles (not shown) as drilling fluid 272, into mechanical horsepower to rotate the drill bit 210. The number of revolutions per minute (bit rpm) at which a downhole motor 220 turns the drill bit 210 is a function of the type of power section 280 selected for use in the downhole motor 220 and the flow rate of the drilling fluid 272 through the motor 220.

Figure 4:
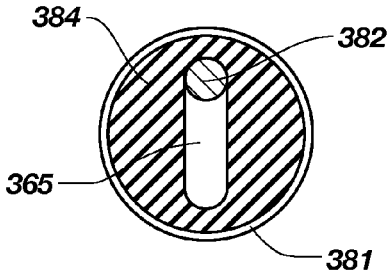
FIG. 4 depicts a schematic of an oblique cross-section of a power section of the embodiment of a downhole motor depicted in FIG. 3.
Figure 3:
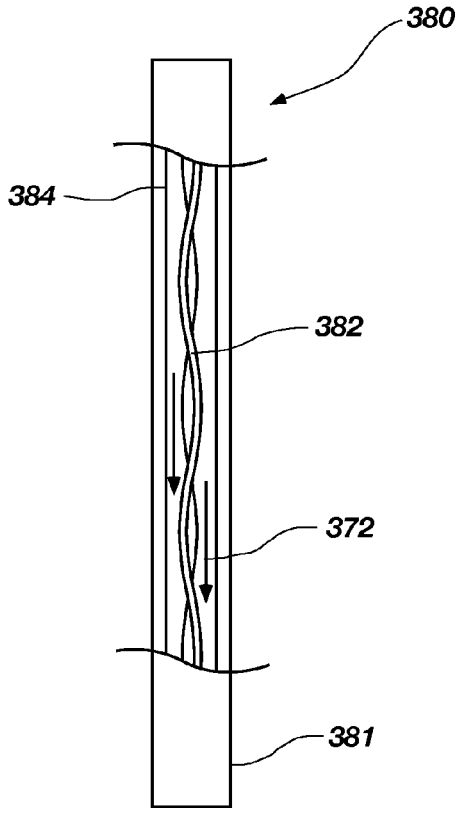
FIG. 3 depicts a schematic of a partial cross-section of a power section of an embodiment of a downhole motor.

The power section 280 of the downhole motor 220 may be selected for a particular application. For example, FIGS. 3 and 4 depict cross-sectional views of a power section 380 of a PDM 220 that includes the outer diameter 381 of the PDM 220, a rotor 382, a stator 384, and a fluid passage 365. The rotor 382 and the stator 384 of a given downhole motor 220 may each have a respective number of lobes, or segments, in a defined ratio termed the rotor/stator ratio. In this example, a rotor/stator ratio 1:2, is depicted in FIGS. 3 and 4, and indicates a high speed (i.e., relatively higher bit rpm)/low torque motor that may be suitable for lower compressive strength formations. In comparison, a rotor/stator ratio of 7:8 (not shown) would indicate a low speed (i.e., relatively lower bit rpm)/high torque motor that may be suitable for higher compressive strength formations. Besides the rotor/stator configuration, the amount of drilling fluid that may pass through a motor, usually referred to as the operating flow rate and given as a range, such as 400-800 gallons per minute (gpm), is a function, in large part, of the diameter of the motor. Thus, among other parameters, a motor may be selected for its particular power section 380 and its operating flow rate.

During actual drilling operations, the flow rate of the drilling fluid 372 that flows through the power section 380 of the downhole motor 220 relates directly to the drill bit rpm. For example, as the flow rate of the drilling fluid 372 through the power section 380 increases the drill bit rpm increases in a fixed ratio related to the rotor/stator ratio. Likewise, as the flow rate of the drilling fluid 372 through the power section 380 decreases the drill bit rpm decreases. A similar effect occurs with turbines; however, rather than a rotor stator ratio, the bit rpm is a function of the number of stages, among others, in the turbine.

Figure 5:
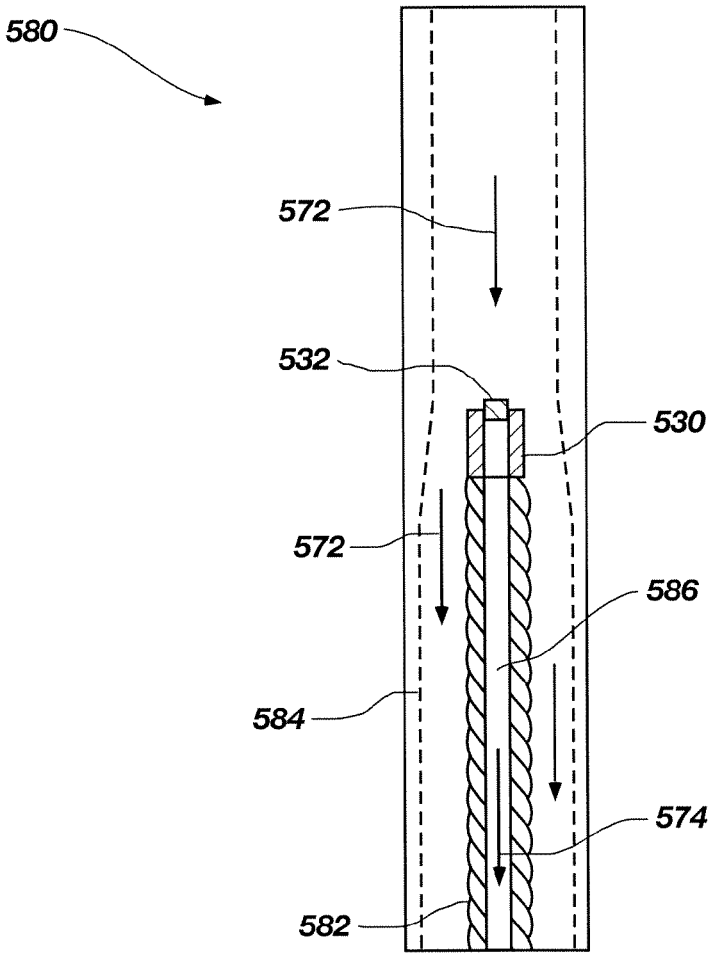
FIG. 5 depicts a schematic partial longitudinal cross-section of an embodiment of the present invention that includes the power section of a downhole motor and a bypass valve assembly.

An embodiment of a bypass valve assembly 530 of the present invention may be seen in FIG. 5, which depicts an upper portion of a power section 580 of the downhole motor 220, comprising rotor 582 and stator 584. In this embodiment, the bypass valve assembly 530 may be configured near the top of the rotor 582 and may include a bypass valve 532. The bypass valve 532 may provide a path for drilling fluid 572 to at least partially bypass the power section 580 of the downhole motor 220 by diverting a portion of the drilling fluid 572 to a hollow core 586 in the rotor 582. Drilling fluid 574 diverted through the hollow core 586 may rejoin the drilling fluid 572 that passed through the power section 580 of the downhole motor 220 at a point below the power section 580 before exiting through nozzles (not shown) in the drill bit 210 (FIG. 2). Through this arrangement, the drill bit 210 may receive approximately the full flow of the drilling fluid 572, 574 in the drill string, which may aid in cleaning and cooling the drill bit 210 and the cutting elements on the drill bit 210 and in carrying the formation cut by the drill bit 210 away from the bottom of the well bore. This arrangement of having the bypass valve 532 located proximate an upper portion of the bypass valve assembly 530 may be used to accurately control the amount of drilling fluid 574 that is diverted from the power section 580 of the downhole motor 220.

Figure 6:
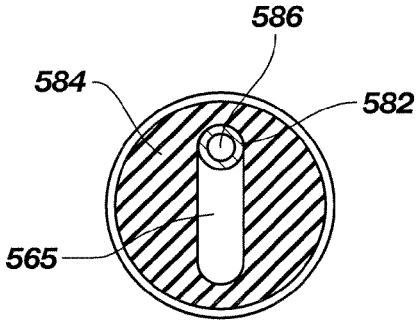
FIG. 6 depicts a schematic of an oblique cross-section of the embodiment of a power section of a downhole motor depicted in FIG. 5.

The hollow core 586 of rotor 582 may pass approximately through the centerline of the rotor 582, as seen FIG. 6. A diameter of the hollow core 586 may be selected, at least in part, to determine the maximum amount of fluid 574 (FIG. 5) that may be diverted through the hollow core 586 instead of fluid passage 565. In addition, making reference to FIGS. 5 and 6, a size, or diameter of the bypass valve 532 may also be selected at least in part, to determine the maximum amount of fluid 574 that may be diverted through the hollow core 586.

Figure 7:
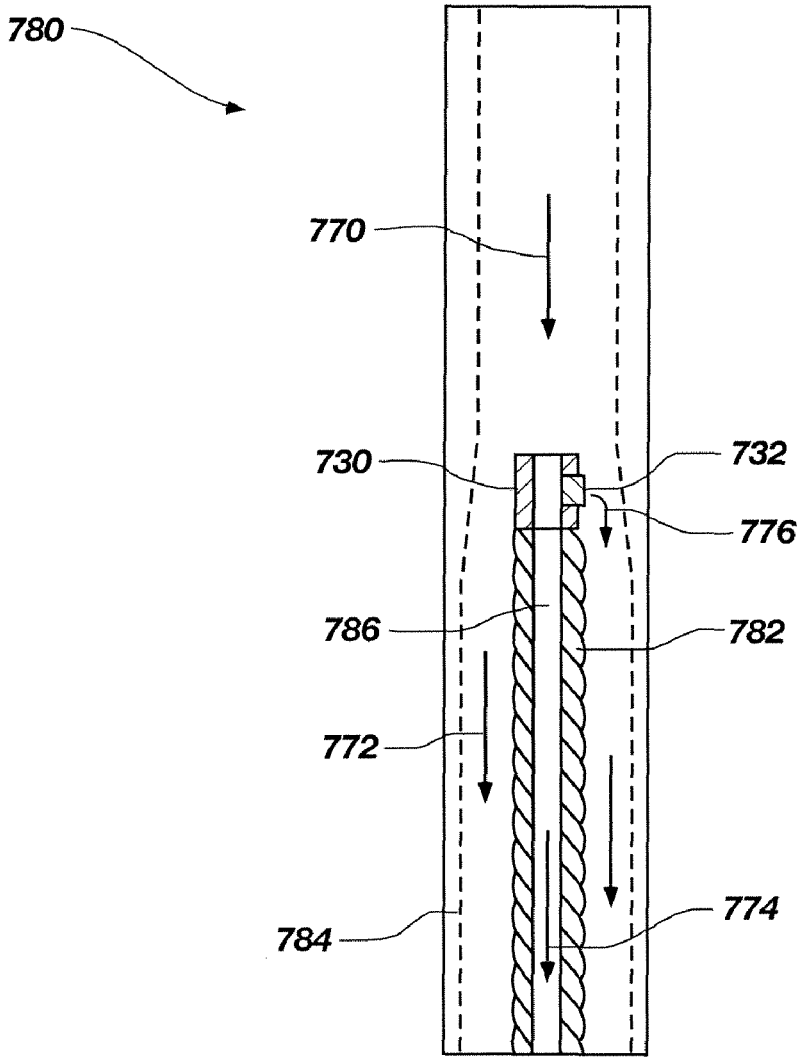
FIG. 7 depicts another embodiment that includes the power section of a downhole motor and a bypass valve assembly.

While FIG. 5 depicts a bypass valve 532 located proximate the top of the bypass valve assembly 530 and, therefore, may act to prevent drilling fluid 572 from entering the hollow core 586 of the rotor 582, another embodiment may position a bypass valve 732 proximate a lateral portion of a bypass valve assembly 730 as seen in FIG. 7. In this instance, at least a portion of drilling fluid 770 may initially enter a hollow core 786 of a rotor 782; however, a portion of drilling fluid 776 may be diverted back into a power section 780 of the downhole motor 220 in conjuction with drilling fluid 772 between rotor 782 and stator 784 while the remainder of the diverted drilling fluid 774 passes through the rotor 782. This arrangement of having the bypass valve 732 located proximate a lateral portion of the bypass valve assembly 730 may provide the benefit of being more resistant to any erosion caused by the drilling fluid 774 than the arrangement of the bypass valve 532 depicted in FIG. 5. Of course, one having ordinary skill in the art will appreciate that other arrangements and locations of the bypass valve fall within the scope of the invention.

Figure 8:
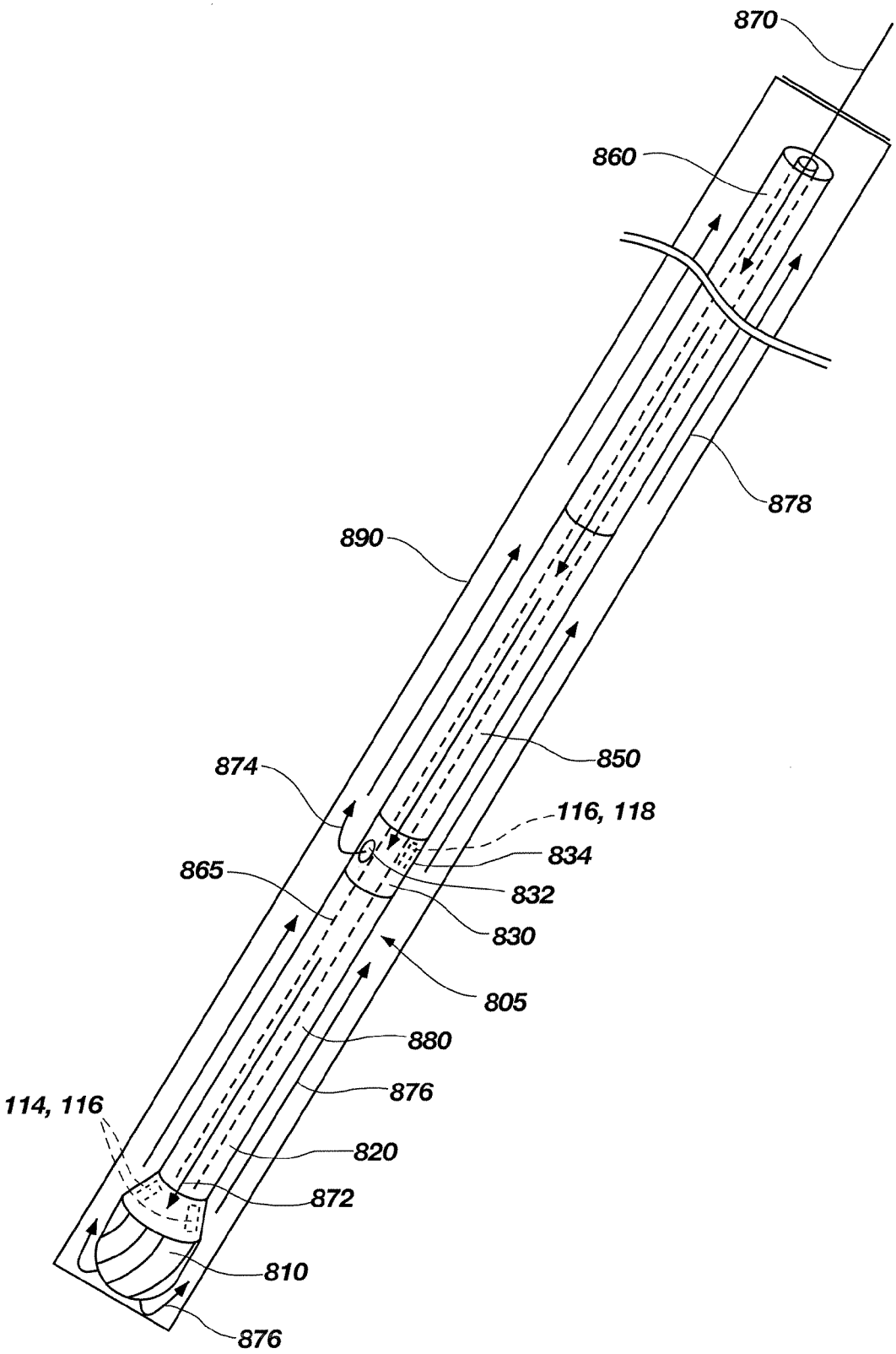
FIG. 8 schematically depicts another embodiment of a drilling system that includes a drill bit, downhole motor, bypass valve assembly, and a MWD system.

Referring to FIG. 8, another embodiment of a bypass valve assembly 830 may include a bypass valve 832. The bypass valve 832 shown in FIG. 8 above downhole motor 820 may provide another path for drilling fluid 870 to at least partially bypass the power section 880 of the downhole motor 820 by diverting a portion 874 of the drilling fluid 870 to the well bore 805 rather than to a hollow core 586, 786 of the rotor 582, 782 as described above and as depicted in FIGS. 5-7, respectively.

Regardless of a particular configuration of the bypass valve assembly 530, 730, 830 used, the bypass valve 532, 732, 832 may be electronically controlled by a processor 116 and a software program that are part of the bypass valve assembly 530, 730, 830. The processor 116 may be mounted on a special board, or cartridge, that may be mounted in a drill collar or drilling sub (a short drilling collar) 134, 834 as known in the art. In this manner, the processor 116 may be placed in a variety of drilling collars or subs that are configured to receive the cartridge on which the computer processor is mounted, which drilling collar or sub may be the same as, or different from, that housing the bypass valve itself, depending on the configuration of the bottom hole assembly and bypass valve employed.

Additionally, the cartridge may include flash memory, electrically erasable programmable read only memory chips (EEPROM), or other memory storage devices 118 known in the art, to store the software program. Raw and calibrated data measured by the sensors, operating parameters, diagnostic information, and the like, may be stored on the same memory storage device 118 as the software program or on other memory storage devices 118 that may be included on the cartridge for later diagnosis and downloading at the surface through an external computer interface, as known in the art.

The processor 116 and the software program may communicate with a variety of sensors 114 that make measurements of various parameters downhole, regardless of whether the sensors 114 are located within the bypass valve assembly 130 or within other downhole tools (e.g., the drill bit 110, the MWD system 150, any LWD tools, etc., as depicted in FIG. 1) through a physical electrical connection, electromagnetic (e-mag) telemetry, or other forms of downhole communication known to those of ordinary skill in the art. The processor 116 also may communicate with the MWD system 150, providing the MWD system 150 with data and the present status of the bypass valve 532, 732, 832 (e.g., open, closed, diagnostics, error messages) of the bypass valve assembly 130, 530, 730, 830 for further communication to the surface.

The processor 116 may be used to initiate the opening and the closing of the bypass valve 532, 732, 832 according to instructions in the software program, diverting at least a portion of the drilling fluid 170 away from a power section 180 of the downhole motor 120 (see FIG. 1). As described above, the drilling fluid may be diverted through the hollow core 586, 786 of the rotor 582, 782, as in FIGS. 5 and 7, or from the inner bore of the BHA 805 out through the bypass valve 832 (referenced as drilling fluid pottion 874) to the annulus between the wellbore wall 890 and the BHA 805, as depicted in FIG. 8. In so doing, the amount of drilling fluid 172 that reaches the power section 180 of the downhole motor 120 may decrease from that which would have otherwise reached the power section 180 of the downhole motor 120 and, consequently, the downhole rpm of the drill bit 110 is decreased. Thus, the bypass valve assembly 130 may permit the downhole rpm to be controlled at least partly independently of the flow rate of the drilling fluid 170. Stated differently, the flow rate of the drilling fluid 170 going into the drill string 160 at the surface may remain substantially constant while the flow rate of the drilling fluid 172 through the power section 180 of the downhole motor 120 may be adjusted automatically through the use of the bypass valve assembly 130.

The MWD system 150 may be used to gather data from sensors 114 integral to the MWD system 150 and other various sensors in the downhole tools in the BHA 105 including, as noted above, drill bit 110. The sensors may include a variety of types, including tri-axial accelerometers, magnetometers, shock sensors, and the like. The telemetry equipment 152 of the MWD system 150 may be used to transmit the data to the surface by encoding the data in a series of pressure fluctuations that it creates in the drilling fluid 170. The encoded pressure pulses may be sensed by pressure transducers at the surface and decoded by surface computers. Optionally, the MWD system 150 may employ other methods of communicating data to the surface, including e-mag telemetry and others known to those of ordinary skill in the art.

Optionally, and as depicted in FIG. 1, the bypass valve assembly 130 may be positioned closer to the drill bit 110 than the MWD system 150. In this way, the MWD system 150 receives the entire flow of the drilling fluid 170 through the bore of the BHA 105 and the drill string 160, which may increase the strength of the encoded pressure pulses transmitted to the surface. The bypass valve assembly 130, located below the MWD system 150, may then divert a portion of the drilling fluid 170 away from the power section 180 of the motor 120 as described above, before the entire flow of the drilling fluid 170 reaches the downhole motor 120. In this manner, the strength of the pressure pulses encoded by the telemetry assembly of the MWD system 150 may be preserved while retaining the benefit of controlling the rpm of the downhole motor 120 and of the drill bit 110 by diverting drilling fluid 170 from the power section 180 of the downhole motor 120.

A further advantage of placing the bypass valve assembly 130 below the MWD system 150 is that an accurate estimate of the drilling fluid 170 passing through the MWD system 150 and the power section 180 of the motor 120 may be calculated which may, therefore, permit a calculation of the amount of drilling fluid 170 being diverted by the bypass valve assembly 130. For example, the MWD system 150 may include a turbine assembly (not shown) that converts a portion of the hydraulic horsepower of the drilling fluid 170 into electrical energy that may be used to power the various tools and sensors in the BHA 105. The turbine may turn at a known ratio with respect to the flow rate of the drilling fluid 170 passing through the turbine. By measuring the revolutions per minute at which the turbine spins (turbine rpm), the flow rate of the drilling fluid 170 through the turbine may be calculated.

After passing through the bypass valve assembly 130, in which a portion of the drilling fluid 170 may be diverted away from the power section 180 of the downhole motor 120, the remaining drilling fluid 172 passes through the power section 180 of the downhole motor 120. As discussed above, the downhole motor 120 turns the drill bit 110 at a known ratio with respect to the flow rate of the drilling fluid 172 passing through the power section 180 of the downhole motor 120. By measuring the RPM of the drill bit 110, the rotor 282, or the turbine (in the case of a turbodrill or turbine motor), the amount of drilling fluid 172 flowing through the power section 180 of the downhole motor 120 may be calculated. By subtracting the flow rate of the drilling fluid 172 through the power section 180 of the motor 120 from the flow rate of the drilling fluid 170 through the turbine assembly of the MWD system 150, the amount of drilling fluid 172 that is diverted through the bypass valve assembly 130 may be calculated.

Figure 9:
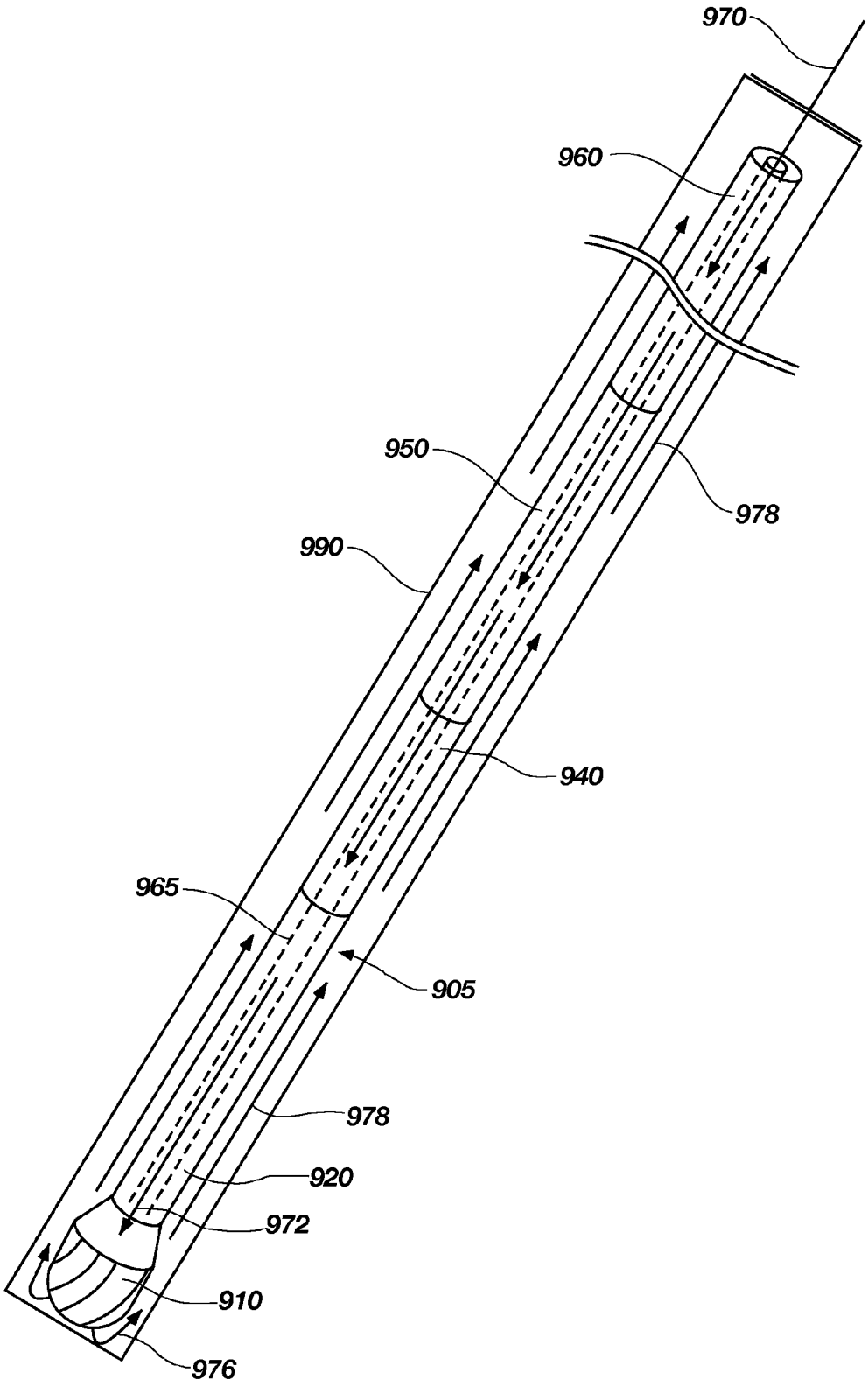
FIG. 9 schematically depicts another embodiment of the present invention that includes a downhole motor, thruster, and a MWD system.

Turning to FIG. 9, a BHA 905 may include a thruster 940, in addition to a drill bit 910, a downhole motor 920, an MWD system 950 and further BHA and other components of drill string 960, as described above. An example of a thruster that may be used in the practice of the invention is described in U.S. Patent Application Publication No. 2001/0045300 to Fincher, et al., assigned to the assignee of the present invention and the disclosure of which is hereby incorporated herein by reference. The thruster 940 may provide an axial force, i.e., a force along the long axis of the BHA 905. The force applied by the thruster 940 may be used to damp shocks or sudden variations in the axial force as a result of the drilling process or the less than complete efficiency in which WOB is transferred from the surface to the drill bit 910 and which may, therefore, keep the cutting elements of the drill bit 910 in nearly constant contact with the formation. Additionally, because the thruster 940 is placed near the drill bit 910, the force applied by the thruster 940 may be transmitted to the drill bit 910 with minimal losses from friction, which may allow the thruster 940 to be used to supplement the force (WOB) applied to the drill bit 910 from the surface, particularly in highly deviated and extended reach wells in which it often is quite difficult to transfer WOB from the surface to the drill bit 910.

Figure 10:
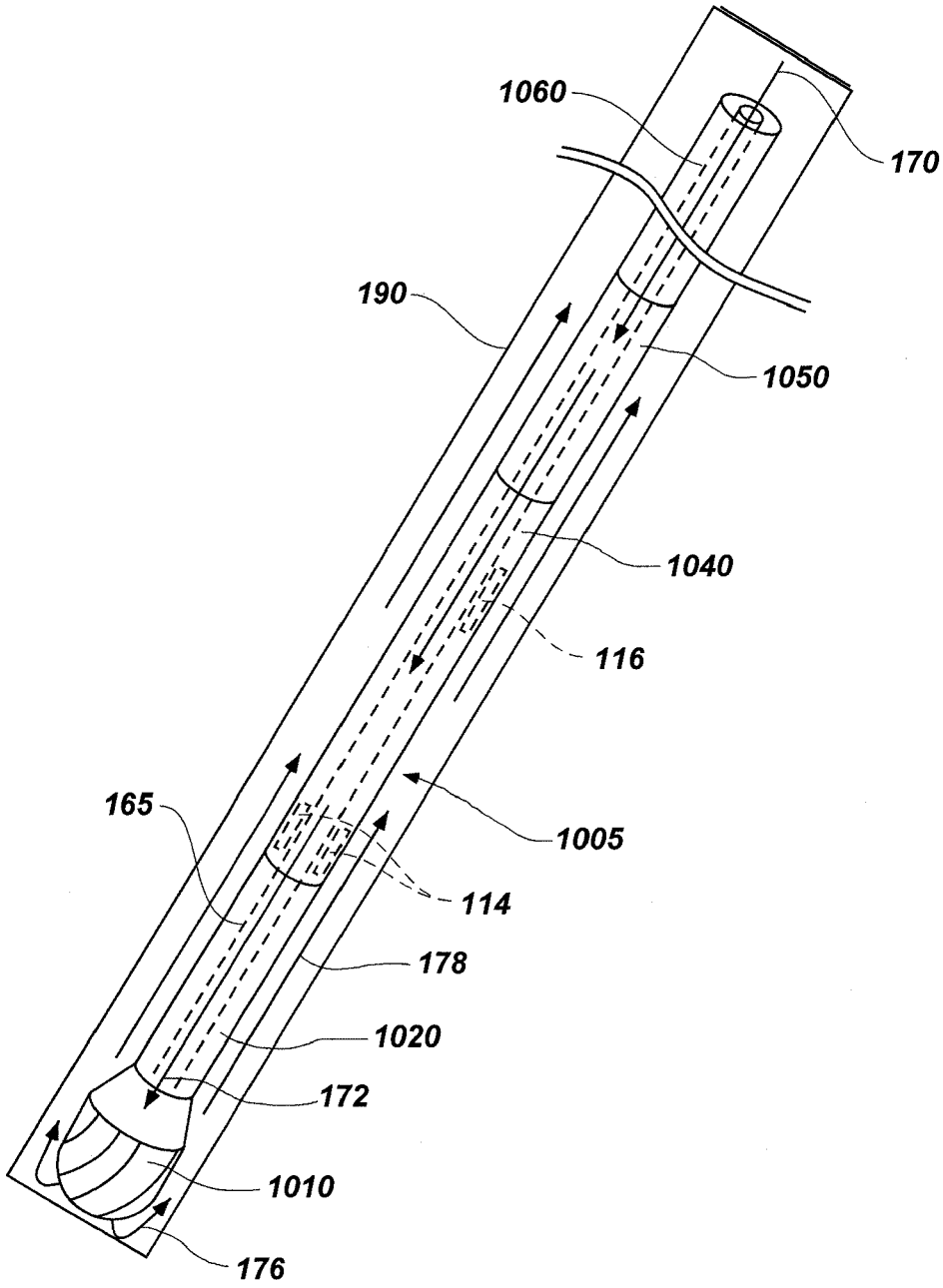
FIG. 10 schematically depicts another embodiment of the present invention that includes a thruster and a MWD system.

Another embodiment of the invention is depicted in FIG. 10. In this instance, the thruster 1040 may be employed in a conventional BHA 1005, i.e., a BHA that does not include a downhole motor or similar device. The conventional BHA 1005 may include a drill bit 1010, a MWD system 1050, and a drill string 1060 connecting the BHA 1005 to the surface, as described above. The conventional BHA 1005 and drill string 1060 must be rotated entirely from the surface in order to turn the drill bit 1010.

Regardless of whether a BHA employs a downhole motor or not, the thruster 1040 may operate hydraulically, similar to the operation of a piston, as known in the art, or may employ a power system and force application device as described in U.S. Patent Application Publication No. 2001/0045300 to Fincher, discussed above. An embodiment of the invention, however, may incorporate a thruster 1040 that has a processor 116 with a software program that communicates with sensors 114 located within the thruster 1040 or within other various components in the BHA 1005. As discussed above vis-a-vis the bypass valve assembly 130, the processor 116 may be mounted on a special board, or cartridge, that may be mounted in a drill collar or drilling sub (a short drilling collar) as known in the art. In this manner, the processor 116 may be placed in a variety of drilling collars or subs that are configured to receive the cartridge on which the computer processor is mounted. Additionally, the cartridge may include flash memory, electrically erasable programmable read only memory chips (EEPROM), or other memory storage devices 118 known in the art, to store the software program. Raw and calibrated data measured by the sensors 114, operating parameters, diagnostic information, and the like, may be stored on the same memory storage device 118 as the software program or on other memory storage devices 118 that may be included on the cartridge for later diagnosis and downloading at the surface through an external computer interface, as known in the art.

The processor 116 may connect with and control the response of the thruster 1040, such as the amount of force the thruster 1040 applies along the axial direction of the BHA 1005 or the rate at which the force is applied. For example, the processor 116 may be operably coupled to an electronic valve that separates at least two reservoirs that hold a hydraulic fluid in the thruster 1040. The electronic valve may be opened and closed at the command of the processor 116, which may alter the rate at which the hydraulic fluid passes between the two reservoirs of the thruster 1040. In so doing, the magnitude of the axial force that the thruster 1040 applies to the drill bit 1010 may be altered in accordance to a software program, as described in further detail below.

Figure 11:
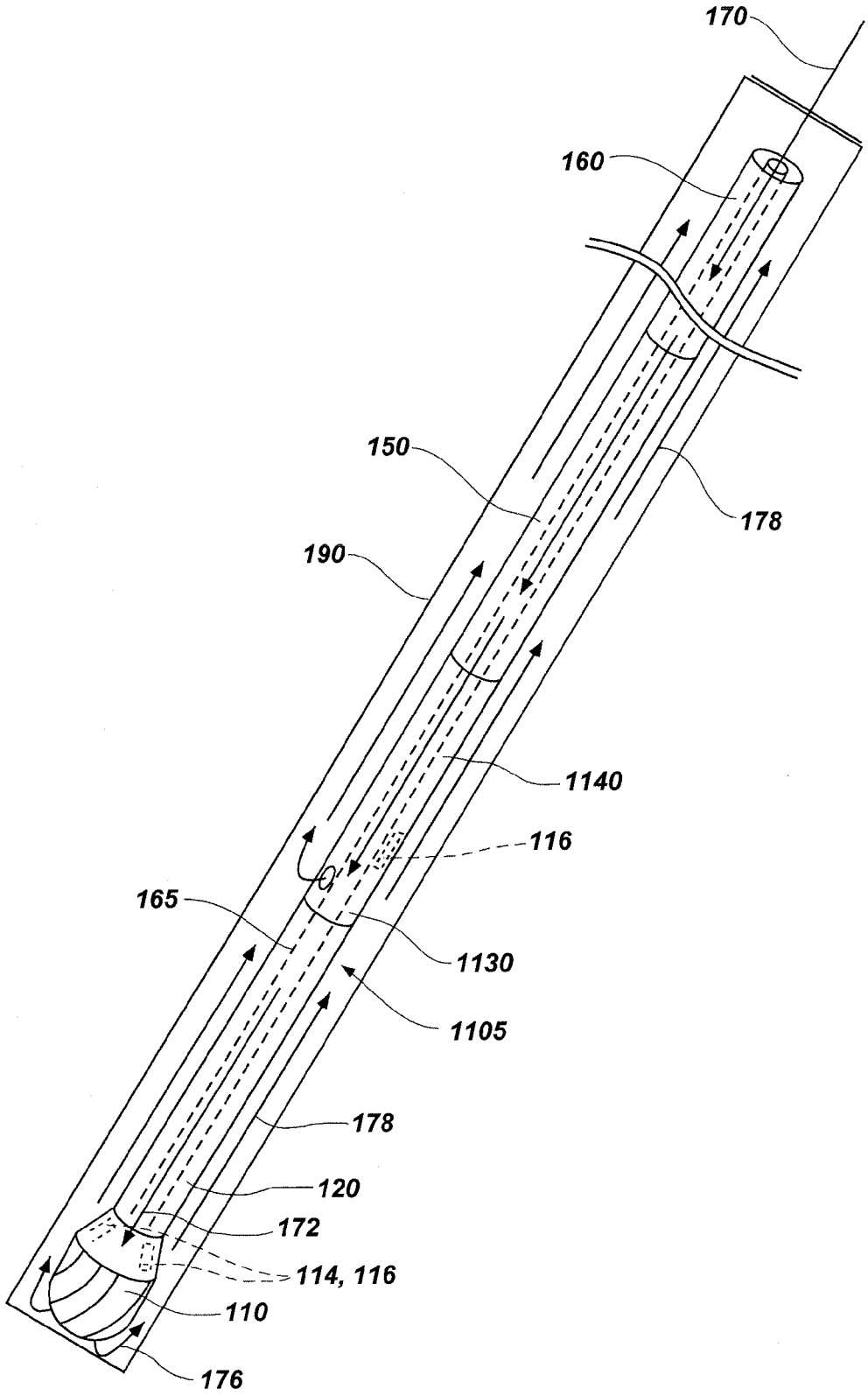
FIG. 11 schematically depicts another embodiment of the present invention that includes a downhole motor, an integrated bypass valve assembly and thruster assembly, and a MWD system.

Optionally, the processors, software, and associated hardware of a bypass valve assembly 1130 and a thruster 1140 may be combined in a single drilling collar or sub, as depicted in FIG. 11. This may provide additional benefit in reducing the number of drilling collars in the BHA 1105, decreasing the overall length of the BHA 1105 as well as decreasing the total number of potential connections between BHA components.

In addition, the processors, software, and hardware of the bypass valve assembly 1130 and the thruster 1140 may be integrated with other components in the BHA, either individually or in combination. For example, a bypass valve assembly 230 may be integrated within the downhole motor 220, as depicted in FIG. 2 as discussed above, or within the same drill collar as the MWD system. An example of the latter, a combined MWD-bypass valve assembly (not shown) may include a bypass valve at the bottom of a MWD system and, therefore, closer to the drill bit, similar in arrangement to the apparatus depicted in FIG. 1. In this way, the MWD system 150 receives the entire flow of the drilling fluid 170 through the fluid passage 165 of the BHA 105 and the drill string 160, which may aid in increasing the strength of the pressure pulse transmitted to the surface. The bypass valve 130, located below the components of the MWD system 150, may then be used to divert any drilling fluid 170 to the annulus between the wellbore wall 190 and the outer diameter of the BHA 105 as described, before the entire flow of the drilling fluid 170 reaches the motor 120. In this manner, the MWD data signal strength may be preserved while retaining the benefit of diverting drilling fluid from the motor.

In one embodiment of a method of the present invention, drilling fluid flow through a bottom hole assembly may be diverted using a bypass valve to such an extent that a downhole motor driven by the fluid flow is caused to rotate the drill bit of the assembly at or near a zero RPM until some selected WOB is achieved after the bit engages the formation being drilled. At such a point, the bypass valve may be used to route a greater extent of drilling fluid flow back through the downhole motor to increase bit RPM to a selected rate for drilling ahead. In such a manner, damaging bit whirl often caused by engagement of a bit at full RPM with the formation at little or no WOB maybe eliminated. As noted above, a processor associated with the bypass valve may be used to maintain bit RPM at a low level until a programmed WOB is achieved, at which point the bypass valve may be opened completely or in stages to bring the bit RPM up to its intended speed for drilling in a non-damaging manner.

In other embodiments of the invention, measured values of downhole performance parameters may be analyzed against drilling performance models of various different subterranean formations and one or more operational aspects of the bottom hole assembly may be altered during drilling to enhance performance of the bottom hole assembly for the type of subterranean formation indicated by the analysis. The indicated type of subterranean formation may also be stored in memory, communicated to the surface, or both, for further, later analysis and to facilitate the optimization of drilling of additional, neighboring wells.

EXAMPLE 1

An embodiment of the invention may be used to optimize the depth to which the cutting elements of the drill bit engage the formation and, hence, optimize the torque and/or the force applied to the drill bit during drilling. In so doing, the life of the drill bit and the drilling tools associated therewith in a BHA may be optimized, i.e., increased. In addition, the rate of penetration (ROP) may be optimized and the cost of drilling the well decreased.

It is usually desirable to maximize the ROP, at least until the point at which the drill bit or downhole tools wear too quickly and require premature replacement. The ROP often is a function, in part, of the WOB and the rpm of the drill bit and frequently increases as the WOB or the rpm increases. As one with ordinary skill may appreciate, however, the ROP is a complex function with many factors, of which WOB and rpm are only two of the factors over which control may be exerted.

In the case of roller cone bits, the wear on the cutting elements and, in particular, the bearings, are directly affected by the WOB and the rpm of the drill bit; ideally, the cutting elements and the bearings would wear to the point that each requires replacement at the same time, all while minimizing the total cost per foot of formation that is drilled.

In the case of PDC drill bits, the wear on the cutting elements is proportional to the linear sliding distance to which the cutting elements are exposed. The depth to which the cutting elements engage the formation, or depth of cut (DOC), has a direct relationship to the linear sliding distance. The DOC may be controlled, in part, by adjusting the WOB, among other factors, and as the WOB increases the DOC increases, provided other factors or elements do not limit the DOC. For example, the ROP in English units may calculated from the equation $$ROP=5*DOC*RPM.$$

Thus, for example, if the DOC was 0.08 inch/revolution and the drill bit rotated at 120 rpm, the ROP would work out to be 48 ft/hr. In comparison, to achieve the same ROP when the drill bit rotates at 240 rpm, the DOC would be only 0.04 inches/revolution, or half the previous example. Thus, in the second example the cutting elements of the drill bit would need to undergo twice the linear sliding distance of the cutting elements from the first example to remove the same amount of formation and, in so doing, the cutting elements in the second example may suffer twice the wear of the cutting elements from the first example.

As the example with the PDC drill bit demonstrates, increasing the DOC, which may be achieved by increasing the WOB, may lead to an increase in ROP. However, as discussed above, too great a WOB may lead overloading the bit, which may result in overloading the cutting elements, stalling the motor, and other problems.

Therefore, regardless of the type of drill bit used, an optimum DOC, rpm, and WOB that leads to an optimum ROP and bit wear may exist, possibly resulting in lower drilling costs, which often is the ultimate objective.

During the drilling process, the drill bit 110 (FIG. 1) may be operated to drill a formation at a given set of parameters, including a given flow rate of drilling fluid 170 and weight on bit, $WOB_1$. As discussed above, by selecting a certain flow rate of drilling fluid 170 the downhole $RPM_1$ of the drill bit 110 may be calculated. With the parameters so defined, an $ROP_1$ may be achieved.

Consider now the situation in which the drill bit 110 drills into a new formation that has a higher compressive strength. Provided that the initial drilling parameters remain unchanged, the $ROP_1$ may decrease to a new, lower $ROP_2$ because the formation has a higher compressive strength. This may be in part because the cutting elements on the drill bit 110 tend to ride up and over the formation instead of adequately biting into the formation. In other words, the cutting elements of the drill bit 110 may be engaging the formation at a more shallow depth of cut. As a result, the torque sensors in the downhole tools or other components of the BHA 105, such as ones located in the drill bit 110, in the other drilling components, or both, may record a decrease in the downhole torque while the $RPM_1$ and the $WOB_1$ as measured by the sensors in the drill bit 110 and the downhole tools remains relatively constant. Optionally, sensors may record lateral vibrations, shocks, and other parameters. As discussed above, the presence of lateral vibrations and shocks may indicate that drill bit 110 and BHA 105 have begun whirling.

A processor 116 incorporated as disclosed above in a component of the BHA 105 may be used to receive the downhole data measured and compare it to one or more drilling models stored in associated memory. By comparing the data to the drilling models, the processor 116 may communicate the downhole data and which of the drilling models the data fits via the telemetry module of the MWD system 150 to the surface.

Additionally, rather than relaying merely a recommendation to the surface with the attendant problems and delays that may incur, the processor 116 may be used to initiate operation of the bypass valve assembly 130 and/or the thruster 140, to modify the operating parameters applied to the drill bit 110 downhole. For example, the processor 116 may command the bypass valve of the bypass valve assembly 130 to open at least partly to divert a portion of the drilling fluid 172 from the drilling fluid 170 that had previously passed through the power section 180 of the motor 120. In so doing, the flow rate of the drilling fluid 172 to the motor 120 is reduced and, therefore, the $RPM_1$ of the drill bit 110 is reduced to $RPM_2$, as described above. With the reduced bit $RPM_2$, the cutting elements of the bit may be less likely to ride up and over the formation, therefore increasing the depth to which the cutting elements of the drill bit 110 cut and, possibly, increasing the rate of penetration to $ROP_2$. The processor 116 may take this action possibly even before the data sent earlier reaches the surface. As such, the optimum flow rate of the drilling fluid 172 through the power section 180 of the motor 120 may be achieved more quickly than previously possible without having to adjust the flow rate of the drilling fluid 170 from the surface.

Optionally, the BHA 105 may employ a thruster 140 in addition to the bypass valve assembly 130 or as an alternative to the bypass valve assembly 130. In the situation described above in which a formation having a higher compressive strength is encountered, the processor 116 in or associated with the thruster 140 may again recognize the torque has decreased for a given $WOB_1$ and $RPM_1$. As a result, the processor 116 in the thruster 140 may command an electronic valve controlling the flow of a hydraulic fluid between two reservoirs in the thruster 140 to close partly and, therefore, increasing the force that the thruster 140 may apply along the axial direction to the drill bit 110, i.e., increasing the force applied to the drill bit 110 to $WOB_2$. In so doing, the cutting elements of the drill bit 110 may be caused to engage the formation more deeply, which may increase the rate of penetration to $ROP_2$.

Regardless of whether a bypass valve assembly 130 and a thruster 140 are both employed in the same BHA 105, whether integrated into a single drilling collar or as separate components, or individually, the processor or processors associated therewith may be used to command each component to operate in a manner that provides an optimal outcome. For instance, an optimal outcome may include achieving an optimal DOC, WOB, the highest ROP, the most endurance (e.g., the lowest wear rate), minimizing vibrations and/or shocks, or some combination thereof that reduces, and perhaps minimizes, the total drilling costs.

If a formation with a lower compressive strength is encountered by the drill bit 110, the sensors 114 may measure a sudden increase in torque as the cutting elements of the drill bit 110 engage the softer formation more deeply for a given weight on bit, $WOB_1$. In this instance, the processor may be used to analyze the sudden increase in torque for a given $RPM_1$, and compare the data to various drilling models. In addition to sending the data to the surface, the processor 116 may be used to command the bypass valve of the bypass valve assembly 130 to close at least partly, sending more of the drilling fluid 170 towards the power section 180 of the downhole motor 120 rather than bypassing all of the drilling fluid 170 away from the power section 180, thus increasing the rate at which the drill bit 110 turns to $RPM_2$. In so doing, the cutting elements of the drill bit 110 may be caused to engage the formation less deeply, which may improve rate of penetration to $ROP_2$ and the wear rate of the drill bit 110.

In the situation described above in which a formation having a lower compressive strength is encountered and where a thruster 140 is employed in the BHA 105, the processor 116 in the thruster 140 may again be used to recognize the torque has increased for a given $WOB_1$ and $RPM_1$. As a result, the processor 116 in the thruster 140 may be used to command an electronic valve controlling the flow of a hydraulic fluid between two reservoirs in the thruster 140 to open partly and, therefore, decreasing the force that the thruster 140 may apply in the axial direction to the drill bit 110, i.e., decreasing the force applied to the bit to $WOB_2$. In so doing, the cutting elements of the drill bit 110 may be caused to engage the formation less deeply.

Regardless of whether a bypass valve assembly 130 and a thruster 140 are both employed in the same BHA 105, whether integrated into a single drilling collar or as separate components, or individually, the processors associated with each component may be used to command each component to operate in a manner that provides an optimal outcome. For instance, an optimal outcome may include achieving an optimal DOC, WOB, the highest ROP, the most endurance (lowest wear rate), minimizing vibrations and/or shocks, or some combination thereof that reduces the total drilling costs.

Thus, from the previous example, it may be seen that the embodiments of the invention provide a method of optimizing the DOC and maintaining the torque applied to a drill bit 110 as well as minimizing vibrations and/or shocks in a variety of drilling conditions and formations. In so doing, an optimum range of drilling parameters, including flow rate, WOB, torque, and depth to which the cutting elements of the drill bit 110 engage the formation may be optimized, individually or in combination, which may result in improved ROP, decreased wear on drilling components, and reduced drilling costs.

EXAMPLE 2

While the foregoing example provides an example of occurrences in which the invention may prove useful, others may exist. For example, embodiments of the invention may prove useful in eliminating or at least reducing the severity of drilling dysfunctions that may occur during the drilling process. An example of such drilling dysfunctions may be the phenomenon known as stick-slip.

Stick-slip occurs when a portion of the BHA 105, usually the drill bit 110, stops rotating momentarily while the rest of the drill string 160 and the BHA 105 still rotate from the surface. This may occur because the cutting elements on the drill bit 110 engage the formation too deeply, causing the drill bit 110 to stop rotating and the downhole motor 120 to stall. An indication that this may have occurred is that the pressure of the drilling fluid 170 as measured at the stand pipe at the surface suddenly increases as the power section of the downhole motor 120 stops turning. In addition, sensors that measure the RPM of the drill bit 110 may indicate that the drill bit 110 has stopped rotating or at least the RPM has decreased significantly.

The most common method to remedy stick-slip may be to pull the drill bit 110 off the bottom of the wellbore, reorient a bent sub 288 of the downhole motor 220 (seen in FIG. 2) in the direction desired (if a bent sub is used to drill the well), and increase the surface RPM and/or the flow rate of the drilling fluid 170 (if possible given other constraints known in the art) to increase the drill bit RPM before returning to drilling with a lower WOB. This process, however, may take considerable time.

The present invention, however, may take remedial action that eliminates or reduces the need to take remedial action from the surface. For example, once a suitably programmed processor in the BHA 105 recognizes that stick-slip may be occurring based on the measurements made by the sensors in the BHA 105, it may be used to command the bypass valve 130 to partially close in order to divert less drilling fluid 170 away from the power section of the downhole motor 120. In this way, the drill bit RPM may be increased, decreasing the likelihood of stick-slip occurring.

Similarly, the processor may be used to command the thruster 140, if one is employed in the BHA 105, to partly open the electric valve separating the two hydraulic reservoirs in the thruster 140. In this manner, the force applied to the bit may be decreased, which may decrease the depth to which the cutting elements of the drill bit 110 engage the formation, reducing the likelihood of stick-slip occurring.

While the above example describes the invention responding to a specific drilling dysfunction, the invention, in the disclosed embodiments, may include a processor or processors exhibiting sufficient sensitivity to data input from sensors of the BHA to respond proactively to the data as measured before a specific drilling dysfunction occurs. For example, the processor may recognize that the torque is increasing for a given RPM and WOB. Rather than waiting until the bit stalls and stick-slip occurs, the processor may command one or both of the bypass valve assembly 130 and the thruster 140 to respond appropriately to decrease the likelihood that a drilling dysfunction may occur.

Additionally, while the examples describe situations in which the drilling parameters change in response to a change in a formation drilled or a drilling dysfunction that occurs, the invention may be applied in other situations in which it is desired to monitor and adjust drilling parameters downhole. For example, the operating parameters may be adjusted to optimize the DOC, enhance the ROP, wear rates of the bit and BHA components, reducing vibrations and decreasing the total drilling costs with minimal intervention from the surface. Similarly, the invention may be useful in either preventing or mitigating other drilling dysfunctions such as bit whirl, shocks, and the like.

Although the foregoing description contains many specifics and examples, these should not be construed as limiting the scope of the present invention, but merely as providing illustrations of some of the embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein and which fall within the meaning of the claims are to be embraced within their scope.

What is claimed is:

1. A downhole drilling assembly for controlling a manner of engagement of a drill bit with a subterranean formation, comprising:

a bottom hole assembly comprising:

a drill bit including at least one cutting structure thereon;

a downhole motor having a power section adapted to convert energy from drilling fluid passing through the bottom hole assembly to rotate the drill bit, the downhole motor including a rotor; and a bypass valve assembly configured to adjust at least one aspect of operation of the downhole drilling assembly that affects at least one of a force and a speed with which the at least one cutting structure may engage a subterranean formation being drilled by the drill bit, wherein the bypass valve assembly is configured to divert at least a portion of a drilling fluid flowing through the bottom hole assembly through an interior bore of the rotor and wherein the bypass valve assembly is configured to divert at least another portion of the drilling fluid flowing through the bottom hole assembly through the bypass valve assembly into the power section of the downhole motor;

at least one sensor configured to measure at least one downhole drilling parameter; and a processor operably coupled to the at least one sensor and the bypass valve assembly to cause the bypass valve assembly to adjust the at least one aspect of operation of the downhole drilling assembly responsive to input from the at least one sensor.

2. The downhole drilling assembly of claim 1, wherein a bypass valve of the bypass valve assembly is positioned between a fluid path extending through the interior bore of the rotor and another fluid path extending through the power section of the downhole motor.

3. The downhole drilling assembly of claim 2, wherein the bypass valve comprises a valve configured for response to commands from the processor.

4. The downhole drilling assembly of claim 3, wherein the valve configured for response to commands from the processor further comprises a route to divert drilling fluid to flow from an interior of the downhole bottom hole assembly to an annulus between a wellbore wall and an exterior of the bottom hole assembly.

5. The downhole drilling assembly of claim 1, further comprising at least one memory storage device.

6. The downhole drilling assembly of claim 5, wherein the memory storage device is configured to store data from the at least one sensor.

7. The downhole drilling assembly of claim 5, wherein the memory storage device is configured to store a computer program for operation of the processor.

8. The downhole drilling assembly of claim 1, wherein the at least one sensor comprises at least one of an RPM sensor, a torque sensor, an axial force sensor, and a shock sensor.

9. The downhole drilling assembly of claim 1, further comprising a hydraulic thruster configured to adjust a force applied along an axis of the bottom hole assembly to the drill bit.

10. The downhole drilling assembly of claim 9, further comprising a valve configured for response to commands from the processor comprising a route for at least partially restricting a flow of a fluid from a first reservoir of the hydraulic thruster to a second reservoir of the hydraulic thruster.

11. The downhole drilling assembly of claim 1, further comprising a device for communicating with at least one of another component in the bottom hole assembly and a surface system.

12. The downhole drilling assembly of claim 11, wherein the device for communicating with at least one of another component in the bottom hole assembly and a surface system further comprises at least one of an electromagnetic telemetry device, a pressure modulating device, and an electrical connecting device.

13. A method of drilling a well, comprising:

measuring a value of at least one downhole drilling performance parameter associated with operation of a downhole drilling assembly, the downhole drilling assembly comprising:

a bottom hole assembly comprising:

a drill bit including at least one cutting structure thereon;

a downhole motor having a power section adapted to convert energy from drilling fluid passing through the bottom hole assembly to rotate the drill bit, the downhole motor including a rotor; and a bypass valve assembly configured to adjust at least one aspect of operation of the downhole drilling assembly that affects at least one of a force and a speed with which the at least one cutting structure may engage a subterranean formation being drilled by the drill bit, wherein the bypass valve assembly is configured to divert at least a portion of a drilling fluid flowing through the bottom hole assembly through an interior bore of the rotor and wherein the bypass valve assembly is configured to divert at least another portion of the drilling fluid flowing through the bottom hole assembly through the bypass valve assembly into the power section of the downhole motor;

at least one sensor configured to measure at least one downhole drilling parameter; and a processor operably coupled to the at least one sensor and the bypass valve assembly to cause the bypass valve assembly to adjust the at least one aspect of operation of the downhole drilling assembly responsive to input from the at least one sensor; and analyzing the at least one downhole drilling performance parameter value;

adjusting the bypass valve assembly in response to the analyzed at least one downhole drilling parameter value to alter at least one aspect of operation of the bottom hole assembly; and repeating the measuring, analyzing, and adjusting until a desired downhole drilling performance parameter value is achieved.

14. The method of claim 13, wherein measuring the value of at least one downhole parameter associated with operation of the bottom hole assembly is conducted at the drill bit.

15. The method of claim 13, wherein adjusting the bypass valve assembly comprises adjusting the bypass valve assembly to alter a flow path of at least a portion of the drilling fluid flowing through the bottom hole assembly.

16. The method of claim 13, wherein adjusting the bypass valve assembly comprises altering the at least one aspect of operation responsive to the analyzing the at least one downhole performance parameter value indicating a type of subterranean formation being drilled.

17. The method of claim 13, wherein analyzing the at least one downhole drilling performance parameter value further comprises comparing the at least one measured downhole drilling performance parameter value to at least one drilling performance model.

18. The method of claim 17, wherein comparing the at least one measured downhole drilling performance parameter value to at least one drilling performance model comprises comparing the at least one measured downhole drilling performance parameter value to performance models for different types of subterranean formations and the analyzing the at least one downhole drilling performance parameter value comprises determining at least one characteristic of a type of subterranean formation being drilled, and wherein adjusting the bypass valve assembly comprises altering at least one aspect of operation of the bottom hole assembly to enhance performance of the bottom hole assembly responsive to the determined at least one characteristic.

19. The method of claim 13, wherein repeating the measuring, analyzing, and adjusting until a desired drilling performance parameter value is achieved further comprises repeating the measuring, analyzing, and adjusting until at least one of an optimal rate of penetration, optimal wear rate, an optimal depth of cut of at least one of a cutting element on a drill bit, and an optimal drilling cost is achieved.

20. The method of claim 19, wherein repeating the measuring, analyzing, and adjusting until at least one of an optimal rate of penetration, optimal wear rate, and optimal drilling cost is achieved further comprises repeating the measuring, analyzing, and adjusting until at least one of a maximum rate of penetration, minimal wear rate, and a minimal drilling cost is achieved.

21. The method of claim 13, further comprising communicating at least one of the measured downhole drilling performance parameter value, the analyzed downhole drilling parameter value, and a status of the bypass valve assembly to at least one of another component in a bottom hole assembly and a surface system.

22. The method of claim 13, wherein measuring of the at least one downhole drilling performance parameter comprises measuring at least one of a bit RPM, a turbine revolutions per minute, a downhole torque, an axial force, and a shock.

* * * * *

UNITED STATES PATENT AND TRADEMARK OFFICE

CERTIFICATE OF CORRECTION

PATENT NO. : 7,921,937 B2
APPLICATION NO. : 11/970103
DATED : April 12, 2011
INVENTOR(S) : Van J. Brackin and Paul E. Pastusek It is certified that error appears in the above-identified patent and that said Letters Patent is hereby corrected as shown below:

In the claims:

CLAIM 1, COLUMN 18, LINE 4, change

"hole drilling parameter; and a processor operably" to

--hole drilling parameter; and a processor operably--

Signed and Sealed this
Twenty-seventh Day of August, 2013

Teresa Stanek Rea
*Acting Director of the United States Patent and Trademark Office*